US010927847B2

(12) United States Patent
Craft et al.

(10) Patent No.: US 10,927,847 B2
(45) Date of Patent: Feb. 23, 2021

(54) COOLANT PUMP FOR AN INTERNAL COMBUSTION ENGINE

(71) Applicant: Ford Global Technologies, LLC, Dearborn, MI (US)

(72) Inventors: Justin Craft, Royal Oak, MI (US); William Michael Sanderson, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 346 days.

(21) Appl. No.: 15/927,221

(22) Filed: Mar. 21, 2018

(65) Prior Publication Data

US 2019/0292974 A1 Sep. 26, 2019

(51) Int. Cl.

| | |
|---|---|
| ***F04D 29/40*** | (2006.01) |
| ***F01P 5/12*** | (2006.01) |
| ***F04D 1/00*** | (2006.01) |
| ***F04D 29/58*** | (2006.01) |
| ***F04D 29/42*** | (2006.01) |
| ***F04D 29/10*** | (2006.01) |
| *F04D 13/06* | (2006.01) |

(52) U.S. Cl.

CPC ..... *F04D 29/406* (2013.01); *F01P 5/12* (2013.01); *F04D 1/00* (2013.01); *F04D 29/106* (2013.01); *F04D 29/426* (2013.01); *F04D 29/586* (2013.01); *F04D 13/06* (2013.01)

(58) Field of Classification Search

CPC ..... F01P 5/12; F04D 17/08; F04D 17/125; F04D 29/102; F04D 29/106; F04D 29/40; F04D 29/403; F04D 29/406; F04D 29/4206; F04D 29/5806; F04D 29/586

See application file for complete search history.

(56) References Cited

U.S. PATENT DOCUMENTS

| | | | | |
|---|---|---|---|---|
| 5,195,867 | A | 3/1993 | Stirling | |
| 5,489,187 | A * | 2/1996 | Ray | B01F 3/04617 415/111 |
| 8,506,238 | B2 * | 8/2013 | Slike | F04D 29/128 415/106 |
| 9,157,448 | B2 * | 10/2015 | Smith | F04D 29/126 |
| 2017/0009777 | A1 | 1/2017 | Krug | |
| 2017/0027405 | A1 | 2/2017 | Li et al. | |
| 2017/0138367 | A1 | 5/2017 | Garvin et al. | |
| 2018/0283399 | A1 * | 10/2018 | Gu | F04D 29/58 |

* cited by examiner

*Primary Examiner* — Courtney D Heinle
*Assistant Examiner* — Sang K Kim
(74) *Attorney, Agent, or Firm* — Brooks Kushman P.C.; Geoffrey Brumbaugh

(57) ABSTRACT

A pump is provided with a pump housing defining a volute chamber positioned between a central inlet and an impeller face, with the housing defining a recess intersecting the face and surrounding an aperture, and the housing defining sequentially first and second ramps, a wall section, and a protrusion extending into the recess. An impeller is positioned within the chamber adjacent to the face, with the impeller connected to a drive shaft extending through the aperture. A method is provided for cooling a drive shaft sealing member by controlling fluid flow through the pump.

16 Claims, 4 Drawing Sheets

COOLANT PUMP FOR AN INTERNAL COMBUSTION ENGINE

TECHNICAL FIELD

Various embodiments relate to a pump, such as a coolant pump for an internal combustion engine.

BACKGROUND

Internal combustion engines often include cooling systems that provide coolant flow through passages formed in the engine block. The cooling system has a pump to drive coolant flow through the system, and the pump is often mechanically driven by the crankshaft or other rotating component of the engine. The pump used with the cooling system may be a centrifugal pump that includes an impeller within the pump chamber to drive the fluid through the pump.

SUMMARY

In an embodiment, a pump is provided with a housing defining a volute chamber extending to an impeller face, with the housing defining a recess formed by a dished wall intersecting the face and surrounding a pump drive shaft aperture. The housing defines sequentially first and second ramps, a wall section, and a protrusion extending from the dished wall into the recess, with the first and second ramps and the wall section intersecting the face. A channel is defined by the second ramp, the wall section, and the dished wall; and the channel is positioned radially opposite an outlet from the volute chamber. The first ramp is positioned between the outlet and the second ramp, and the protrusion is positioned between the wall section and the outlet.

In another embodiment, a pump is provided with a pump housing defining a volute chamber positioned between a central inlet and an impeller face, with the housing defining a recess intersecting the face and surrounding an aperture, and the housing defining sequentially first and second ramps, a wall section, and a protrusion extending into the recess. An impeller is positioned within the chamber adjacent to the face, with the impeller connected to a drive shaft extending through the aperture.

In yet another embodiment, a method of cooling a pump drive shaft seal is provided. Fluid flow is directed from a volute chamber through a gap formed between an impeller and an impeller face and into a recess bounded by the impeller face and surrounding a pump drive shaft. Fluid flow is directed via a first inclined ramp extending into the recess, and is directed via a second inclined ramp extending into the recess. Fluid flow is fed from the gap through a channel and into the recess. Fluid flow is guided using an end face of a wall section extending into the recess, thereby increasing velocity of the fluid flow. A fluid separation is induced using a protrusion extending into the recess. The first ramp, second ramp, the channel, the wall section, and the protrusion are sequentially arranged in the recess in a direction of impeller rotation, with the channel being radially opposite an outlet from the volute chamber.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
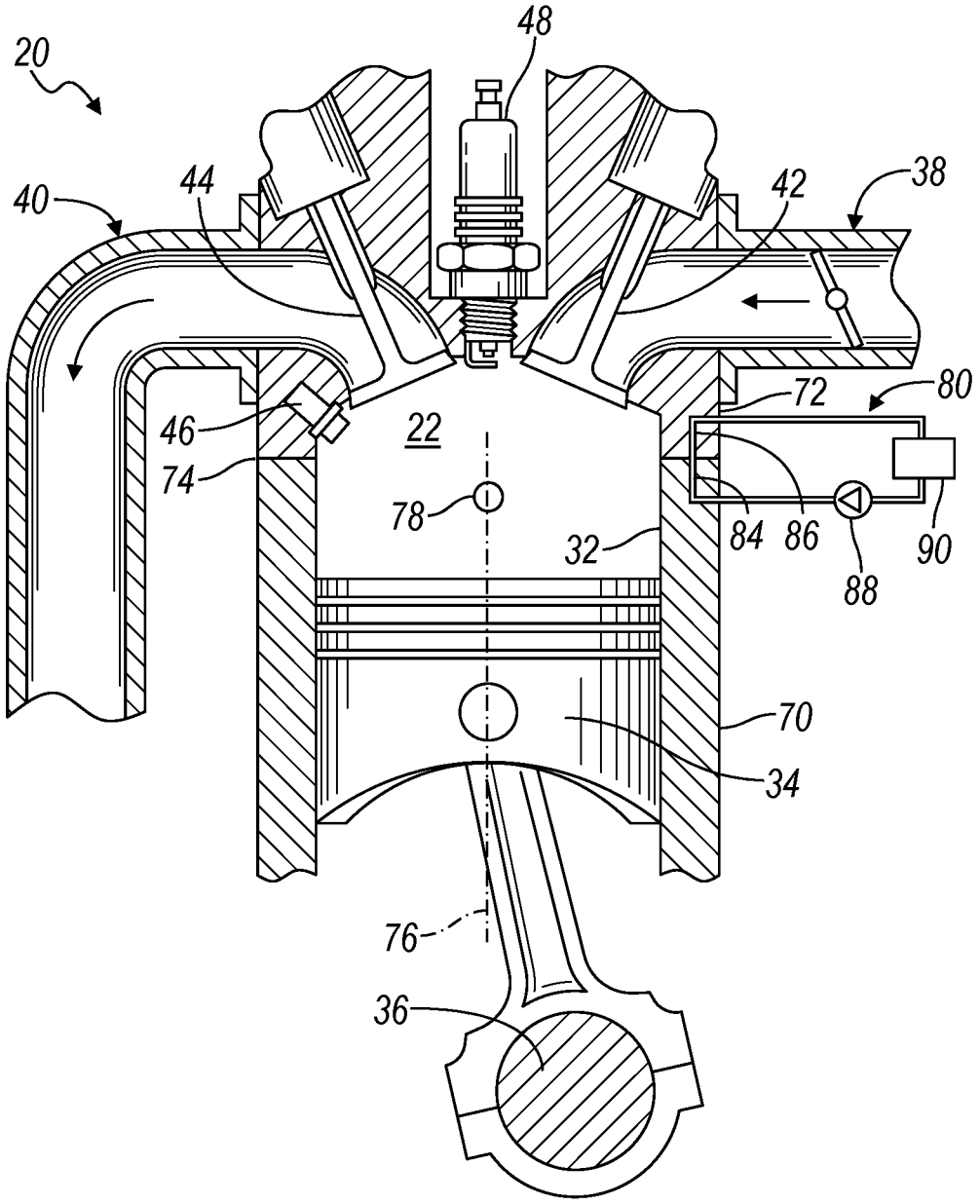
FIG. 1 illustrates a schematic of an internal combustion engine and fluid system according to an embodiment.
Figure 2:
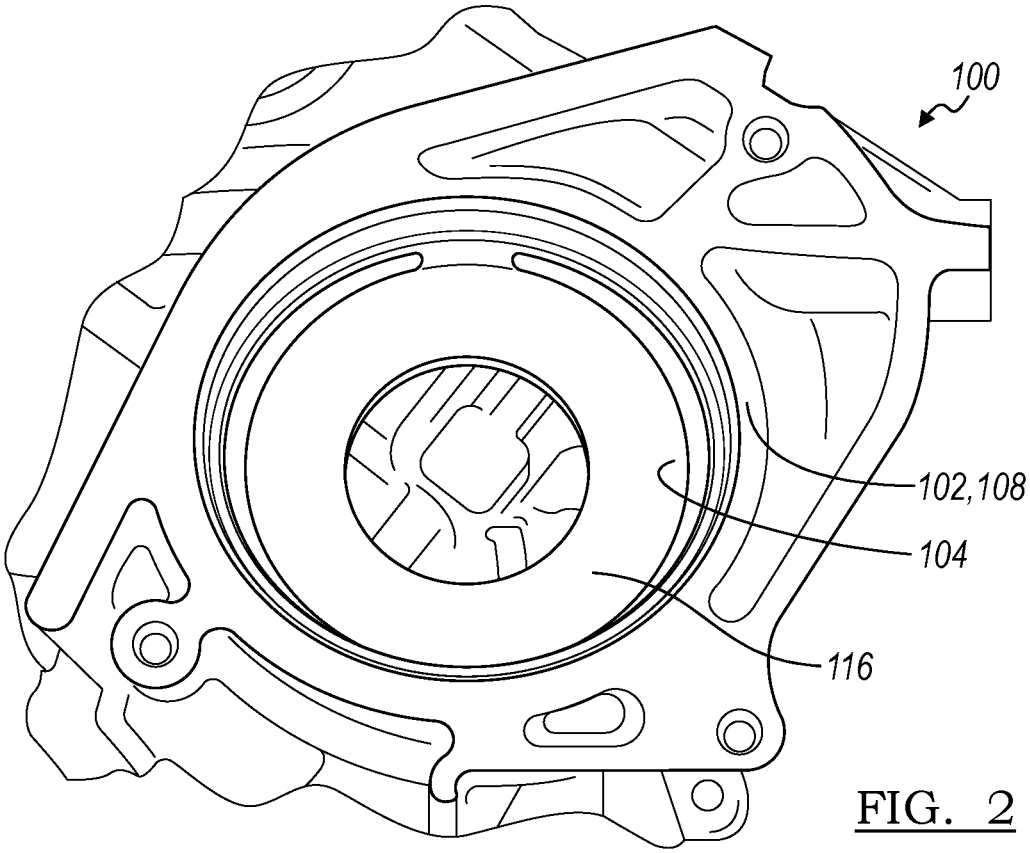
FIG. 2 illustrates a perspective view of a housing member for a coolant pump according to an embodiment.
Figure 3:
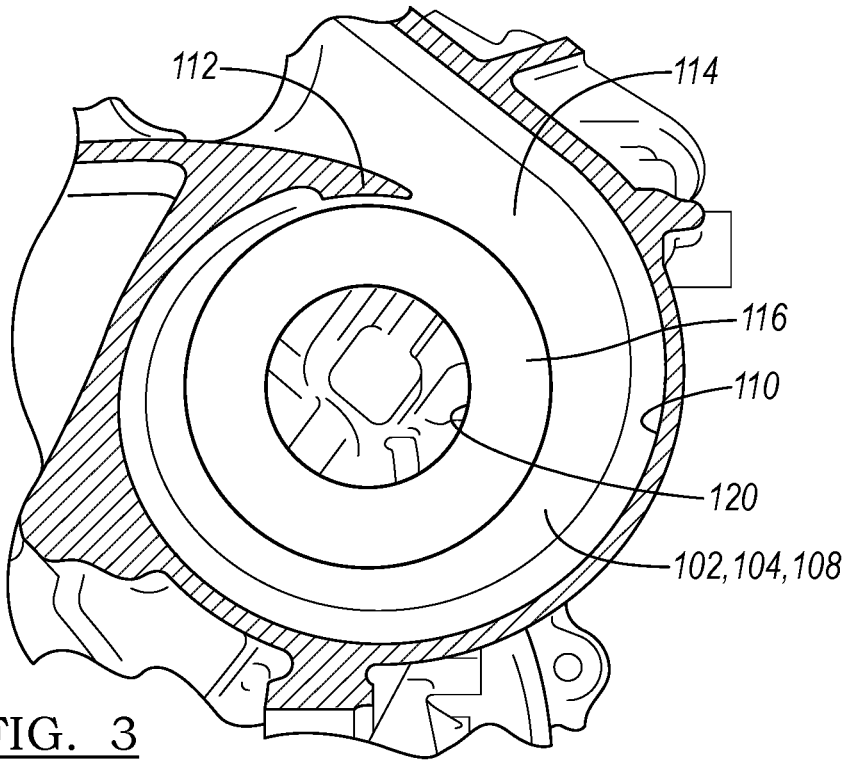
FIG. 3 illustrates a sectional view of the housing member according to FIG. 2.
Figure 4:
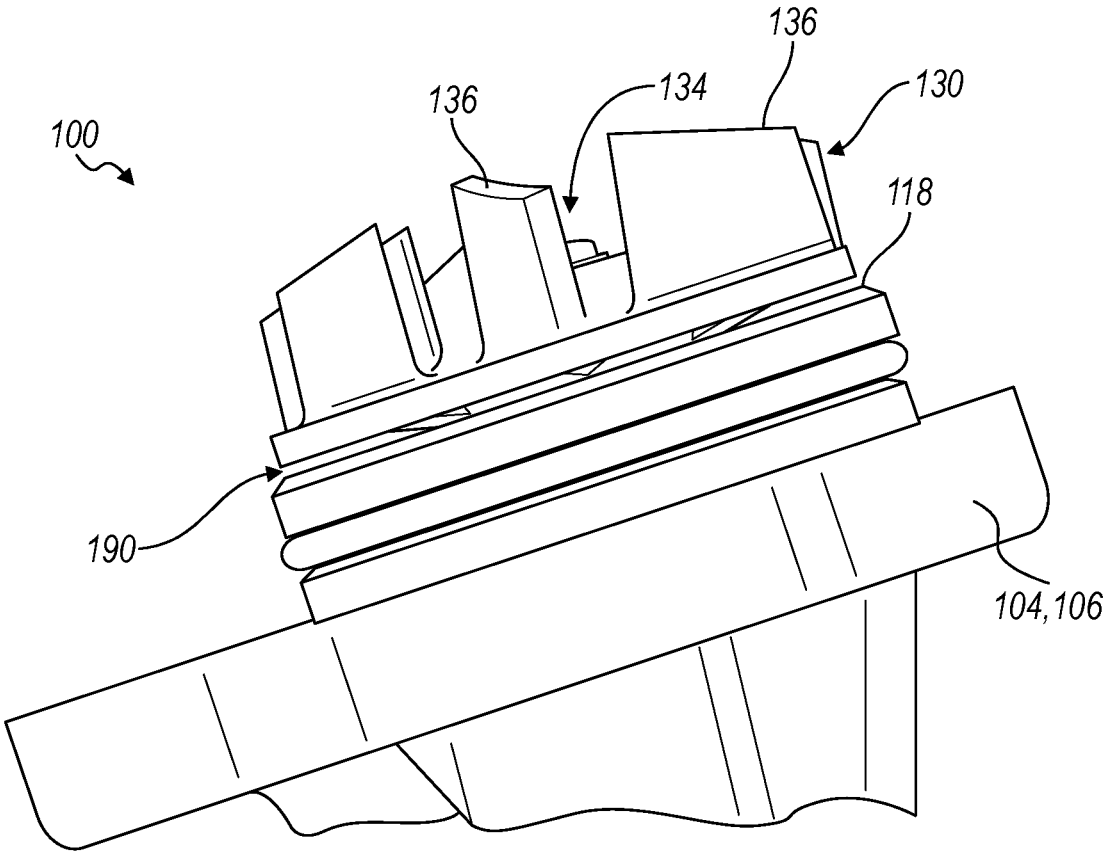
FIG. 4 illustrates a perspective view of another housing member and an impeller for the coolant pump of FIG. 2.
Figure 5:
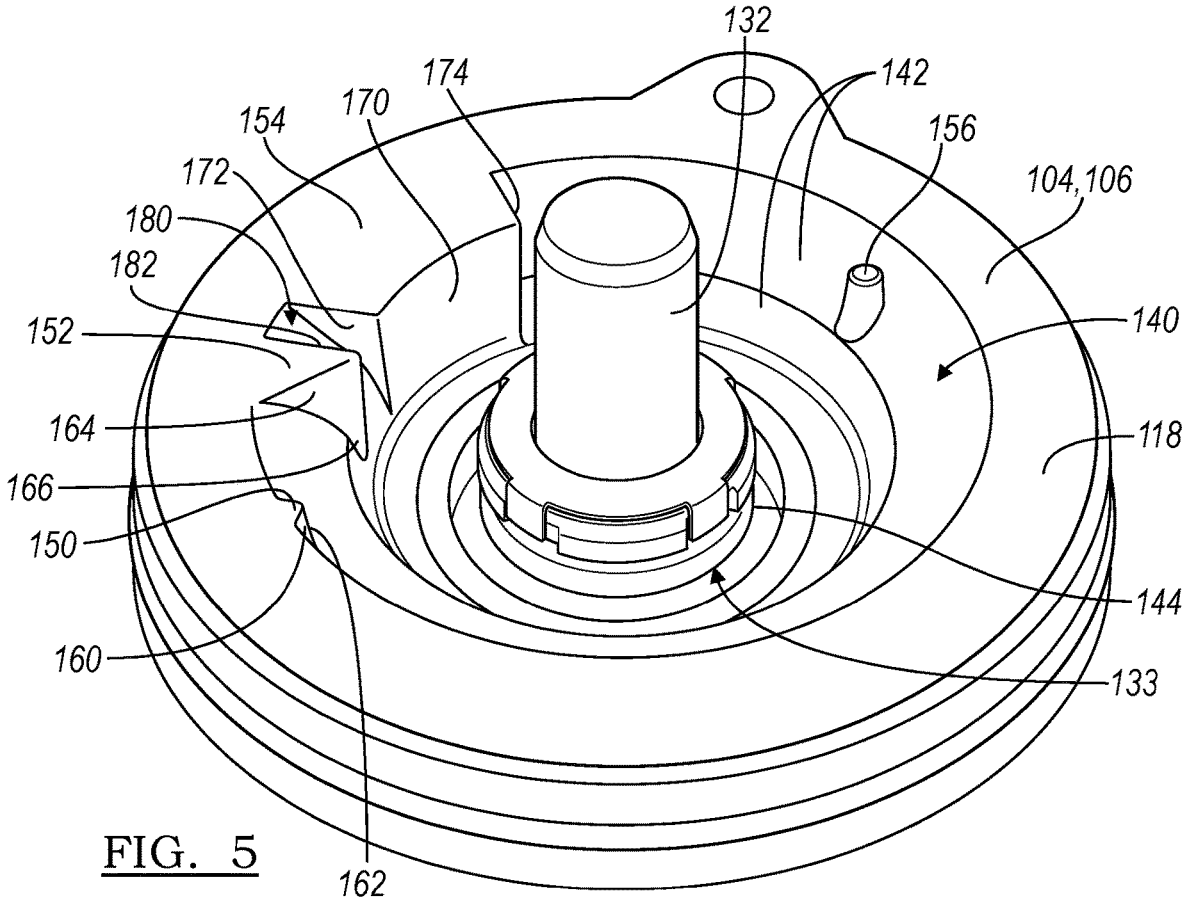
FIG. 5 illustrates a perspective view of the housing member of FIG. 4.
Figure 6:
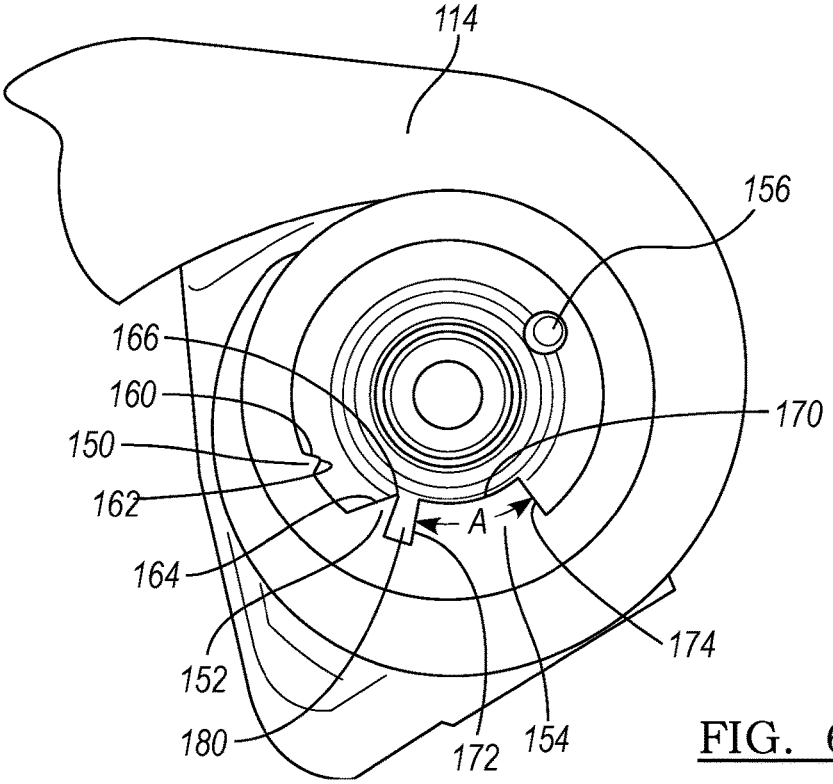
FIG. 6 illustrates a schematic illustrating the flow features of the housing member of FIG. 4 relative to the volute in the housing member of FIG. 2.

FIG. 1 illustrates a schematic of an internal combustion engine 20. The engine 20 has a plurality of cylinders 22, and one cylinder is illustrated. The engine 20 may have any number of cylinders, and the cylinders may be arranged in various configurations. The engine 20 has a combustion chamber associated with each cylinder 22. The cylinder 22 is formed by cylinder walls 32 and piston 34. The piston 34 is connected to a crankshaft 36. The combustion chamber and cylinder 22 is in fluid communication with the air intake system 38 or intake manifold 38 and the exhaust manifold 40. An intake valve 42 controls flow from the intake manifold 38 into the combustion chamber and cylinder 22. An exhaust valve 44 controls flow from the combustion chamber and cylinder 22 to the exhaust manifold 40. The intake and exhaust valves 42, 44 may be operated in various ways as is known in the art to control the engine operation.

A fuel injector 46 delivers fuel from a fuel system directly into the cylinder 22 such that the engine is a direct injection engine. A low pressure or high pressure fuel injection system may be used with the engine 20, or an intake port injection system may be used in other examples. An ignition system includes a spark plug 48 that is controlled to provide energy in the form of a spark to ignite a fuel air mixture in the cylinder 22. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust manifold 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust manifold 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two-stroke cycle. The engine 20 may be configured for spark ignition or for compression ignition.

The engine 20 has a cylinder block 70 and a cylinder head 72 that cooperate with one another to form the cylinders 22. A head gasket or other sealing member may be positioned between the block 70 and the head 72 to seal the cylinder 22. The cylinder block 70 has a block deck face that corresponds with and mates with a head deck face of the cylinder head 72 along part line 74, and the head gasket may be positioned therebetween.

The engine 20 includes a fluid system 80 such as a cooling system to remove heat from the engine 20. In another example, the fluid system 80 may additionally act as a lubrication system to lubricate engine components.

For a cooling system 80, the amount of heat removed from the engine 20 may be controlled by a cooling system controller or the engine controller. The system 80 may be integrated into the engine 20 as one or more cooling jackets. The system 80 has one or more cooling circuits that may contain a coolant as the working fluid. In one example, the cooling circuit has a first cooling jacket 84 in the cylinder block 70 and a second cooling jacket 86 in the cylinder head 72 with the jackets 84, 86 in fluid communication with each other. The block 70 and the head 72 may have additional cooling jackets. Coolant, such as water, glycol, or another liquid medium, in the cooling circuit 80 and jackets 84, 86 flows from an area of high pressure towards an area of lower pressure.

The fluid system 80 has one or more pumps 88. In a cooling system 80, the pump 88 provides pressurized fluid in the circuit to fluid passages in the cylinder block 70 and to the head 72. The cooling system 80 may be a parallel flow, split flow, parallel-split flow, or other cooling arrangement. The pump may be driven via a mechanically coupling to the crankshaft and/or a coupling to an electric motor. The cooling system 80 may also include valves and/or thermostats (not shown) to control the flow or pressure of coolant, or direct coolant within the system 80. The cooling passages in the cylinder block 70 may be adjacent to one or more of the combustion chambers and cylinders 22. Similarly, the cooling passages in the cylinder head 72 may be adjacent to one or more of the combustion chambers and cylinders 22, and the exhaust ports for the exhaust valves 44. Fluid flows from the cylinder head 72 and out of the engine 20 to a heat exchanger 90 such as a radiator where heat is transferred from the coolant to the environment.

FIGS. 2-6 illustrate a pump 100 such as a centrifugal cooling pump according to an embodiment. The pump 100 may be used as pump 88 in the engine 20 of FIG. 1 above or may be used as a pump for another vehicle fluid system. The pump 100 has a housing 102 that defines a volute chamber 104 or pumping chamber. The housing 102 may be formed from various housing members or components that are connected to one another to form the pump and seal the volute chamber. In one example, a cover member 106 or housing member is connected to another housing member 108 to form the pump housing. In another example, and as shown, at least a portion of the volute chamber 104 is defined by a cylinder block, and a cover member is connected to the cylinder block to form the pump 100 and seal the volute chamber 104.

The volute chamber 104 or volute is defined by the housing members 106, 108 and has an outer wall 110 extending circumferentially about the chamber, and has a cutwater 112 adjacent to a pump outlet 114. As shown in the Figures, the pump 100 may be a single volute pump. The outer wall 110 may be provided at a constant distance, or substantially constant distance given various cutouts, etc., from a central axis. The outer wall 110 of the volute chamber 104 extends between first and second opposite faces 116, 118 of the volute chamber. The first face 116 may be referred to as a shroud face, and the second face 118 may be referred to as an impeller face.

The pump 100 has a central pump inlet 120 located generally in a central region of the pump, with the pump inlet 120 defined by an aperture surrounded by the shroud face 116 of the housing. The pump outlet 114 is provided along the outer wall 110 of the volute chamber. The pump outlet 114 is fluidly connected to an inlet passage for one or more cooling jackets for the engine 20 to provide coolant thereto for thermal management of the engine.

An impeller 130 is positioned within the volute chamber 104 and is connected to a pump drive shaft 132. The impeller 130 is rotated within the volute chamber 104 by the drive shaft 132 during pump operation, and to induce fluid flow from the pump inlet 120 to the pump outlet 114. The impeller 130 may rotate about the central axis of the pump 100, or may rotate about a drive shaft axis that is offset from and parallel to the central axis. The pump 100 may be mechanically driven with the shaft 132 mechanically connected to the crankshaft 36 of the engine, for example via an accessory drive system, such that the impeller 130 is driven by the crankshaft. In other examples, the impeller 130 of the pump may be electrically driven, for example using an electric motor connected to the pump drive shaft 132. The drive shaft 132 extends through an aperture 133 defined by the housing and surrounded by the impeller face 118, as described in further detail below.

The impeller 130 has an impeller eye 134 and a series of vanes or ribs 136. The pump inlet 120 is adjacent to the eye 134 of the impeller, for example at or near an axis of rotation of the impeller 130 and/or the central axis of the volute chamber 104. The eye 134 provides a suction inlet to the pump. Fluid flows into the pump 100 though the inlet 120 and eye 134 of the impeller. The impeller 130 has a series of vanes or ribs 136 and may be an open, semi-open, or closed impeller design. The vanes or ribs 136 may extend radially outward, backward, or forwards, and may be straight or curved. As the impeller 130 is rotated or driven, the fluid in the volute or pump chamber 104 surrounding the impeller also rotates. The impeller 130 forces the coolant to move radially outwards in the volute 104.

The impeller 130 is sized to extend between the two faces 116, 118, while providing sufficient clearance for rotation of the impeller. In one example, the impeller 130 is spaced from each face by a distance on the order of millimeters. The shroud face 116 and ends of the impeller vanes 136 may be angled or inclined and correspond with one another.

The coolant flows out of the volute 104 via a discharge passage or outlet passage 114. The cutwater 112 is provided at an entrance region to the discharge passage, or the outlet 114 from the pump volute. The outer wall 110 of the volute increases in distance from the axis from the cutwater 112 to the outlet passage 114 and along the flow direction or the rotational direction of the impeller 130. Note that the impeller 130 rotates counterclockwise in the example shown in FIGS. 2, 3, and 6, and clockwise in FIG. 5. This increases the pressure at the discharge region 114 of the pump as the area or volume is increasing and the velocity is decreasing. As the pressure is increased at the discharge passage, the coolant at the eye 134 is being displaced, which causes a suction effect to draw fluid into the volute chamber 104.

The pump shaft 132 extends through an aperture 133 formed in the pump housing. A recess 140 is defined by a concave dished wall 142 of the housing and surrounds the aperture 133. The concave dished wall 142 intersects the impeller face 118 and extends from the aperture 133 to the impeller face 118. A sealing member 144 is positioned to surround the drive shaft 132 and prevent fluid from leaving the volute chamber 104 through the aperture 133. The sealing member 144 is positioned within the recess 140.

The pump housing 106 defines sequentially first and second ramps 150, 152, a wall section 154, and a protrusion 156 extending into the recess 140. The first ramp 150, the second ramp 152, the wall section 154, and the protrusion 156 are circumferentially spaced apart from one another about the recess 140, and are sequentially arranged in the recess in the direction of impeller rotation. These features act to control the fluid flow to direct fluid flow across the recess 140 and across the sealing member 144 to cool the member by inducing cross-flow by the use of guiding surfaces to redirect fluid flow and by the creation of pressure differentials to drive fluid flow to a low pressure region from a high pressure region. By actively inducing fluid flow across the recess 140, convective cooling and thermal management of the sealing member 144 is provided. Conventional pumps may use tabs, or other features, however, fluid may have low flow characteristics in a recess of a conventional pump which may provide thermal stress on the seal as a conductive heat transfer mechanism is the primary thermal pathway. The first ramp 150, the second ramp 152, and the wall section 154 intersect the impeller face 118.

The first ramp 150 may be a wedge-shaped feature. The first ramp 150 acts an as initial flow guide in the recess 140. The first ramp 150 has an upstream face 160, such as inclined face. The inclined face may be planar or have a curvature, and intersects the dished wall 142 and the impeller face 118. The first ramp 150 extends to an end region 162 located at a first distance into recess 140 from the impeller face 118. The first ramp 150 is positioned between the outlet 114 and the second ramp 152.

The second ramp 152 may be a wedge-shaped feature. The second ramp 152 acts a primary flow guide in the recess 140. The second ramp 152 has an upstream face 164, such as inclined face. The inclined face may be planar or have a curvature, and intersects the dished wall 142 and the impeller face 118. The second ramp 152 extends to an end region 166 located at a second distance into recess 140 from the impeller face 118. The end 162 of the first ramp 150 is positioned between the impeller face 118 and the end 166 of the second ramp 152. The area of the upstream face 160 of the first ramp is less than an area of the upstream face 164 of the second ramp.

The wall section 154 defines an end face 170 that is positioned between the impeller face 118 and the aperture 133. The end face 170 of the wall section is radially inset from the dished wall 142 and may have first and second end faces 172, 174 as shown. The wall section 154 extends through an angular section A of the recess 140, for example, with the range being between five to seventy degrees according to one example, and between thirty to seventy degrees according to a further example. The wall section 154 acts to narrow the cross-sectional area of the recess 140 between the wall section 154 and the drive shaft 132, in comparison to the cross-sectional area of the recess 140 between the dished wall 142 and the drive shaft 132 on the opposite side, and the wall section 154 thereby constricts flow in this region.

The end face 170 of the wall section may be curved, or have another shape. In the example shown, the end face 170 is arcuate. The end face 170 may have a constant radius of curvature, or may have a varying radius of curvature. In one example, the end face 170 is an arc that is positioned to be concentric with the aperture 133 and the dished wall 142. The radius of curvature of the end face 170 is less than a radius of curvature of the outer perimeter of the dished wall 142.

A channel 180 is defined between the second ramp 152 and the wall section 154, and intersects the impeller face 118. The channel 180 may be defined by the downstream face 182 or end wall of the second ramp 152, the end face 172 or side wall of the wall section 154, and the dished wall 142. A width of the channel 180, or the distance between the second ramp and the wall section, may be approximately half of the distance between the first and second ramps 150, 152, or less than half of the distance between the first and second ramps. The channel 180 is positioned to be radially opposite to the outlet region 114, within five to twenty-five degrees of radially opposite the outlet region 114 according to one example, or within ten to fifteen degrees of radially opposite the outlet region 114 according to a further example. The channel 180 acts as a feed inlet for fluid flow into the recess.

The protrusion 156 extends from the dished wall 142 into the recessed area 140. The protrusion 156 is positioned radially between the aperture 133 and the impeller face 118. The protrusion 156 is positioned upstream of the outlet 114, and is positioned between the wall section 154 and the outlet 114. The protrusion 156 is shown as having a cylindrical shape; however, other shapes are also contemplated. For example, the protrusion 156 may be wedge shaped, or the like. The protrusion 156 acts as a flow trip feature, and may induce a degree of flow separation or vortex streeting downstream of the protrusion, which facilitates the exit of fluid flow from the recess. The wake zone of the protrusion 156 intersects the radial flow across the recess 140 from channel 180 and aids the flow in exiting the recess. In one example, the first ramp 150 is positioned radially opposite to the protrusion 156, within five to twenty-five degrees of radially opposite the protrusion according to one example, or within ten to fifteen degrees of radially opposite the protrusion according to a further example.

The first and second ramps 150, 152 and the wall section 154 are shown as being flush with the impeller face 118. In further embodiments and if sufficient space is available between the impeller face and the impeller, at least one of the first and second ramps 150, 152 and the wall section 154 may be offset above the impeller face 118.

The first and second ramps 150, 152, the channel 180, the wall section 154, and the protrusion 156 cooperate to both guide and direct the fluid flow through the gap 190 between the impeller 130 and the impeller face 118, into the recess 140, across the sealing member 144 and out of the recess 140 through the gap 190 between the impeller 130 and the impeller face 118 adjacent to the flow outlet 114 from the pump. These flow features in the recess 140 are shaped and positioned to control the vector flow field and to control the pressure field of the fluid, and provide for reduced swirl in the recess 140 as well as increased cross-flow. By creating both a pressure differential or pressure imbalance across the recessed area 140, as well as providing surfaces and features to guide and direct the flow, the pump housing 106 controls the fluid flow across the sealing member 144 to convectively cool the sealing member during pump operation and extend the life of the seal. Modelling results along with laboratory correlations indicate that the pump housing 106 according to FIGS. 2-6 has beyond a three times improvement on seal life over a conventional pump with radially spaced anti-vortex tabs in the recess, or a pump without flow control features in the recess. Note that the rotation of the drive shaft 132 and impeller 130 tends to generate a swirl effect for fluid within the recess 140, where ingress of new fluid is restricted and the swirling fluid within the recess may increase in temperature with pump operation, with the swirling fluid acting as a fluid and thermal barrier around the sealing member. The housing 106 geometry reduces this swirl while including cross-flow of fluid.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the invention.

What is claimed is:

1. A pump comprising:

a housing defining a volute chamber extending to an impeller face, the housing defining a recess formed by a dished wall intersecting the impeller face and surrounding a pump drive shaft aperture, the housing defining sequentially first and second ramps, a wall section, and a protrusion extending from the dished wall into the recess, wherein the first and second ramps and the wall section intersect the impeller face, wherein a channel is defined by the second ramp, the wall section, and the dished wall, the channel being positioned radially opposite an outlet from the volute chamber, wherein the first ramp is positioned between the outlet and the second ramp, and the protrusion is positioned between the wall section and the outlet, wherein the first and second ramps are defined by first and second upstream inclined faces, respectively, wherein an area of the first inclined face is less than an area of the second inclined face; and wherein a width of the channel is less than half of a distance between the first and second ramps.

2. The pump of claim 1 wherein the wall section defines a curved end face intersecting the dished wall and the impeller face, wherein a radius of curvature of the end face is less than a radius of curvature of an outer perimeter of the dished wall.

3. A pump comprising:

a pump housing defining a volute chamber positioned between a central inlet and an impeller face, the housing defining a recess intersecting the impeller face and surrounding an aperture, the housing defining sequentially first and second ramps, a wall section, and a protrusion extending into the recess; and an impeller positioned within the chamber adjacent to the impeller face, the impeller connected to a drive shaft extending through the aperture, wherein a channel is defined between the second ramp and the wall section, wherein the channel is radially opposite an outlet from the volute chamber, and wherein a width of the channel is less than half of a distance between the first and second ramps.

4. The pump of claim 3 wherein the first ramp, the second ramp, the wall section, and the protrusion are circumferentially spaced apart from one another about the recess.

5. The pump of claim 3 wherein the first ramp, the second ramp, and the wall section intersect the impeller face.

6. The pump of claim 3 wherein the protrusion is positioned radially between the aperture and the impeller face.

7. The pump of claim 3 wherein the recess is defined by a concave dished wall extending from the aperture to the impeller face.

8. The pump of claim 7 wherein the first ramp and second ramp are defined by first and second inclined faces, respectively, each inclined face intersecting the dished wall and the impeller face.

9. The pump of claim 8 wherein an area of the first inclined face is less than an area of the second inclined face.

10. The pump of claim 3 wherein the wall section defines an end face positioned between the impeller face and the aperture.

11. The pump of claim 10 wherein the end face extends along an arc concentric with the aperture.

12. The pump of claim 3 wherein the channel is defined by an end wall of the second ramp and a side wall of the wall section.

13. The pump of claim 3 wherein the protrusion is positioned upstream of the outlet.

14. The pump of claim 13 wherein the first ramp is positioned radially opposite to the protrusion.

15. The pump of claim 3 wherein the pump housing defines a single volute.

16. The pump of claim 3 further comprising a sealing member surrounding the shaft and positioned within the recess;

wherein the first and second ramps, the wall section, and the protrusion are configured to direct fluid flow across the recess and past the sealing member to cool the member.

* * * * *